US009940945B2

(12) United States Patent
Xie et al.

(10) Patent No.: US 9,940,945 B2
(45) Date of Patent: Apr. 10, 2018

(54) METHOD AND APPARATUS FOR ELIMINATING MUSIC NOISE VIA A NONLINEAR ATTENUATION/GAIN FUNCTION

(71) Applicant: Marvell World Trade Ltd., St. Michael (BB)

(72) Inventors: Jin Xie, Longmont, CO (US); Kapil Jain, Santa Clara, CA (US)

(73) Assignee: Marvell World Trade Ltd., St. Michael (BB)

( * ) Notice: Subject to any disclaimer, the term of this patent is extended or adjusted under 35 U.S.C. 154(b) by 251 days.

(21) Appl. No.: 14/829,052

(22) Filed: Aug. 18, 2015

(65) Prior Publication Data

US 2016/0064010 A1 Mar. 3, 2016

Related U.S. Application Data

(60) Provisional application No. 62/045,367, filed on Sep. 3, 2014.

(51) Int. Cl.
*G10L 21/02* (2013.01)
*G10L 19/02* (2013.01)
(Continued)

(52) U.S. Cl.
CPC ..... *G10L 21/0264* (2013.01); *G10L 19/0204* (2013.01); *G10L 21/0232* (2013.01);
(Continued)

(58) Field of Classification Search
CPC .. G10L 21/0204; G10L 19/0204; G10L 21/00
(Continued)

(56) References Cited

U.S. PATENT DOCUMENTS 9,130,643 B2 * 9/2015 Chen ..... H04B 1/1661
9,437,212 B1 * 9/2016 Jain ..... G10L 21/0232
(Continued)

FOREIGN PATENT DOCUMENTS

WO WO-2005114656 A1 12/2005

OTHER PUBLICATIONS

U.S. Appl. No. 14/546,552, filed Nov. 18, 2014, Kapil Jain.
(Continued)

*Primary Examiner* — Akwasi M Sarpong

(57) ABSTRACT

A system including first and second gain modules, an operator module, and a priori and posteriori modules. The first gain module applies a non-linear function to generate a gain signal based on an amplitude of a first speech signal and an estimated a priori variance of noise included in the first speech signal. The operator module generates an operator based on the gain signal and the estimated a priori variance of noise. The a priori module determines an a priori signal-to-noise ratio based on the operator. The posteriori module determines a posteriori signal-to-noise ratio based on the amplitude of the first speech signal and (ii) the estimated a priori variance of noise. The second gain module: determines a gain value based on the a priori signal-to-noise ratio and the a posteriori signal-to-noise ratio; and generates, based on the amplitude of the first speech signal and the gain value, a second speech signal that corresponds to an estimate of an amplitude of the first speech signal, where the second speech signal is substantially void of music noise.

25 Claims, 7 Drawing Sheets

(51) Int. Cl.

| | |
|---|---|
| ***G10L 21/0264*** | (2013.01) |
| ***G10L 25/21*** | (2013.01) |
| ***G10L 21/0316*** | (2013.01) |
| ***G10L 21/0232*** | (2013.01) |
| *G10L 21/0208* | (2013.01) |
| *G10L 21/0216* | (2013.01) |

(52) U.S. Cl.
CPC ..... *G10L 21/0316* (2013.01); *G10L 25/21* (2013.01); *G10L 2021/02085* (2013.01); *G10L 2021/02163* (2013.01)

(58) Field of Classification Search
USPC ..... 704/226, 233, 235; 381/94.2
See application file for complete search history.

(56) References Cited

U.S. PATENT DOCUMENTS

| | | | | |
|---|---|---|---|---|
| 9,626,987 | B2 * | 4/2017 | Matsuo | G10L 21/0232 |
| 2002/0002455 | A1 * | 1/2002 | Accardi | G10L 21/0208 704/226 |
| 2008/0082328 | A1 * | 4/2008 | Lee | G10L 25/78 704/234 |
| 2008/0167866 | A1 * | 7/2008 | Hetherington | G10L 21/0208 704/228 |
| 2009/0177468 | A1 * | 7/2009 | Yu | G10L 15/02 704/233 |
| 2009/0310796 | A1 * | 12/2009 | Seydoux | H04M 9/082 381/71.1 |
| 2010/0076769 | A1 * | 3/2010 | Yu | G10L 19/0204 704/269 |
| 2011/0305345 | A1 * | 12/2011 | Bouchard | G10L 21/0208 381/23.1 |
| 2012/0057711 | A1 * | 3/2012 | Makino | G10L 21/0208 381/57 |

OTHER PUBLICATIONS

Y. Ephraim and D. Malah; "Speech Enhancement Using a Minimum Mean-Square Error Short-Time Spectral Amplitude Estimator"; IEEE Transactions on Acoustics, Speech and Signal Processing, vol. ASSP-32, No. 6; Dec. 1984; pp. 1109-1121.

Kapil Jain; "Speech Enhancement Using a Mathematically Efficient Spectral Amplitude Estimator"; Oct. 22, 2013; 20 pages.

IEEE Std. 802.11-2012; IEEE Standard for Information technology—Telecommunications and information exchange between systems Local and metropolitan area networks—Specific requirements; Part 11: Wireless LAN Medium Access Control (MAC) and Physical Layer (PHY) Specifications; IEEE Computer Society; Sponsored by the LAN/MAN Standards Committee; Mar. 29, 2012; 2793 pages.

802.16-2009 IEEE Standard for Local and Metropolitan area networks; Part 16: Air Interface for Broadband Wireless Access Systems; IEEE Computer Society and the IEEE Microwave Theory and Techniques Society; Sponsored by the LAN/MAN Standard Committee; May 29, 2009; 2082 pages.

IEEE Std 802.20-2008; IEEE Standard for Local and metropolitan area networks; Part 20: Air Interface for Mobile Broadband Wireless Access Systems Supporting Vehicular Mobility—Physical and Media Access Control Layer Specification; IEEE Computer Society; Sponsored by the LAN/MAN Standards Committee; Aug. 29, 2008; 1032 pages.

"Specification of the Bluetooth System" Master Table of Contents & Compliance Requirements—Covered Core Package version: 4.0; Jun. 30, 2010; 2302 pages.

IEEE P802.11ac / D2.0; Draft Standard for Information Technology—Telecommunications and information exchange between systems—Local and metropolitan area networks—Specific requirements; Part 11: Wireless LAN Medium Access Control (MAC) and Physical Layer (PHY) specifications; Amendment 4: Enhancements for Very High Throughput for Operation in Bands below 6 GHz; Prepared by the 802.11 Working Group of the 802 Committee; Jan. 2012; 359 pages.

IEEE P802.11ad / D5.0 (Draft Amendment based on IEEE P802.11REVmb D10.0) (Amendment to IEEE 802.11REVmb D10.0 as amended by IEEE 802.11ae D5.0 and IEEE 802.11aa D6.0); Draft Standard for Information Technology—Telecommunications and Information Exchange Between Systems—Local and Metropolitan Area Networks—Specific Requirements; Part 11: Wireless LAN Medium Access Control (MAC) and Physical Layer (PHY) Specifications—Amendment 3: Enhancements for Very High Throughput in the 60 GHz Band; Sponsor IEEE 802.11 Committee of the IEEE Computer Society; Sep. 2011; 601 pages.

IEEE P802.11ah / D1.0 (Amendment to IEEE Std 802.11REVmc / D1.1, IEEE Std 802.11ac / D5.0 and IEEE Std 802.11af / D3.0) Draft Standard for Information technology—Telecommunications and information exchange between systems Local and metropolitan area networks—Specific requirements; Part 11: Wireless LAN Medium Access Control (MAC) and Physical Layer (PHY) Specifications; Amendment 6: Sub 1 GHz License Exempt Operation; Prepared by the 802.11 Working Group of the LAN/MAN Standards Committee of the IEEE Computer Society; Oct. 2013; 394 pages.

Nakai Shunsuke et al.; "Theoretical Analysis of Biased MMSE Short-Time Spectral Amplitude Estimator and Its Extension to Musical-Noise-Free Speech Enhancement"; 2014 4th Joint Workshop on Hands-Free Speech Communication and Microphone Arrays (HSCMA); IEEE; May 12, 2014; pp. 122-126.

International Search Report and Written Opinion for PCT Application No. PCT/US2015/046979 dated Dec. 15, 2015; 13 pages.

* cited by examiner

METHOD AND APPARATUS FOR ELIMINATING MUSIC NOISE VIA A NONLINEAR ATTENUATION/GAIN FUNCTION

CROSS-REFERENCE TO RELATED APPLICATIONS

This application claims the benefit of U.S. Provisional Application No. 62/045,367, filed on Sep. 3, 2014. The entire disclosure of the application referenced above is incorporated herein by reference.

FIELD

The present disclosure relates to attenuation and/or removal of noise in an audio signal.

BACKGROUND

In a speech enhancement system, a digital signal processor (DSP) receives an input signal including samples of an analog audio signal. The analog audio signal may be a speech signal. The input signal includes noise and thus is referred to as a "noisy speech" signal with noisy speech samples. The DSP signal processes the noisy speech signal to attenuate the noise and output a "cleaned" speech signal with a reduced amount of noise as compared to the input signal. Attenuation of the noise is a challenging problem because there is no side information included in the input signal defining the speech and/or noise. The only available information is the received noisy speech samples.

Traditional methods exist for attenuating the noise in a noisy speech signal. These methods, however, introduce and/or result in output of "music noise". Music noise does not necessarily refer to noise of a music signal, but rather refers to a "music-like" sounding noise that is within a narrow frequency band. The music noise is included in cleaned speech signals that are output as a result of performing these traditional methods. The music noise can be heard by a listener and may annoy the listener.

As an example, samples of an input signal can be divided into overlapping frames and a priori signal-to-noise ratio (SNR) $\xi(k,l)$ and a posteriori SNR $\gamma(k,l)$ may be determined, where: $\xi(k,l)$ is the a priori SNR of the input signal; $\gamma(k,l)$ is a posteriori (or instantaneous) SNR of the input signal; l is a frame index to identify a particular one of the frames; and k is a frequency bin (or range) index that identifies a frequency range of a short time Fourier transform (STFT) of the input signal. The a priori SNR $\xi(k,l)$ is a ratio of a power level (or frequency amplitude of speech) of a clean speech signal to a power level of noise (or frequency amplitude of noise). The a posteriori SNR $\gamma(k,l)$ is a ratio of a squared magnitude of an observed noisy speech signal to a power level of the noise. Both the a priori SNR $\xi(k,l)$ and the a posteriori SNR $\gamma(k,l)$ may be computed for each frequency bin of the input signal. The a priori SNR $\xi(k,l)$ may be determined using equation 1, where $\lambda_X(k,l)$ is a priori estimated variance of amplitude of speech of the STFT of the input signal and $\lambda_N(k,l)$ is an estimated a priori variance of noise of the STFT of the input signal.

$$\xi(k, l) = \frac{\lambda_X(k, l)}{\lambda_N(k, l)} \tag{1}$$

The a posteriori SNR $\gamma(k,l)$ may be determined using equation 2, where R(k,l) is an amplitude of noisy speech of the STFT of the input signal.

$$\gamma(k, l) = \frac{R(k, l)^2}{\lambda_N(k, l)} \tag{2}$$

For each k and l, a gain G is calculated as a function of $\xi(k,l)$ and $\gamma(k,l)$. The gain G is multiplied by R(k,l) to provide an estimate of an amplitude of clean speech $\hat{A}(k,l)$. Each gain value may be greater than or equal to 0 and less than or equal to 1. Values of the gain G are calculated based on $\xi(k,l)$ and $\gamma(k,l)$, such that frequency bands (or bins) of speech are kept and frequency bands (or bins) of noise are attenuated. An inverse fast Fourier transform (IFFT) of the amplitude of clean speech $\hat{A}(k,l)$ is performed to provide time domain samples of the cleaned speech. The cleaned speech refers to the noisy speech portion of the STFT of the input signal that is cleaned (i.e. the noise has been attenuated).

For example, when $\xi(k,l)$ is high, amplitude of speech for the corresponding frequency is high and little noise exists (i.e. amplitude of noise is low). For this condition, the gain G is set close to 1 (or 0 dB) to maintain amplitude of the speech. As a result, the amplitude of clean speech $\hat{A}(k,l)$ is set approximately equal to R(k,l). As another example, when $\xi(k,l)$ is low, amplitude of speech for the corresponding frequency is low and strong noise exists (i.e. amplitude of noise is high). For this condition, the gain G is set close to 0 to attenuate the noise. As a result, the amplitude of the clean speech $\hat{A}(k,l)$ is set close to 0.

The a priori signal-to-noise ratio (SNR) $\xi(k,l)$ may be estimated using equation 3, where $\alpha$ is a constant between 0 and 1 and P(k,l) is an operator, which may be expressed by equation 4.

$$\xi(k, l) = \alpha\frac{\hat{A}(k, l-1)}{\lambda_N(k, l-1)} + (1-\alpha)P(k, l) \tag{3}$$

$$P(k, l) = \begin{cases} \gamma(k, l) - 1 = \dfrac{R(k, l)^2 - \lambda_N(k, l)}{\lambda_N(k, l)}, & R(k, l)^2 > \lambda_N(k, l) \\ 0, & \text{otherwise} \end{cases} \tag{4}$$

FIG. 1 shows a noisy speech signal 10 and a clean speech signal 12. The noisy speech signal 10 includes speech (or speech samples) and noise. The clean speech signal 12 is the speech without the noise. An example frame of the noisy speech signal 10 is within box 14. The frame designated by box 14 has little speech (i.e. amplitude of speech is near zero) and a lot of noise (i.e. amplitude of the noise is high compared to the speech for this frame and/or SNR is low).

FIGS. 2A and 2B show plots that illustrate how music noise is produced. FIG. 2A shows examples of amplitudes of true speech, amplitudes of noisy speech R(k,l), and estimated speech amplitudes $\hat{A}(k,l)$. The values of FIG. 2B correspond to the values of FIG. 2A. FIG. 2B shows examples of values of the variables in equation 4.

As illustrated in FIG. 2B, $R(k,l)^2$ and $\lambda_N(k,l)$ are both randomly "zigzag-shaped" and are at about the same averaged level (i.e. have similar amplitudes). At some frequency bins, $R(k,l)^2<\lambda_N(k,l)$ and values of P(k,l) are zero according to equation 4. At other frequency bins, $R(k,l)^2>\lambda_N(k,l)$ and values of P(k,l) are non-zero values according to equation 4.

Since $R(k,l)^2$ and $\lambda_N(k,l)$ are randomly zigzag-shaped at some frequency bins, corresponding values of P(k,l) are non-zero, but values of P(k,l) are zero at frequency bins adjacent to the frequency bins having P(k,l) values of non-zero. Therefore, P(k,l) shows isolated peaks at some frequency bins and according to equation 3 and the a priori SNR $\xi(k,l)$ also has isolated peaks for the same frequency bins. Amplitudes of the isolated peaks of the a priori SNR $\xi(k,l)$ may be smaller than the amplitudes of P(k,l) depending on the value of the constant $\alpha$.

A low value of the a priori SNR $\xi(k,l)$ can lead to a gain that is much smaller than 1 (e.g., close to 0 and greater than or equal to 0). A high value of the a priori SNR $\xi(k,l)$ leads to a gain close to 1 and less than or equal to 1. As a result, the estimated speech amplitude $\hat{A}(k,l)$, which is the gain multiplied by the amplitude of noisy speech R(k,l), has isolated peaks at the frequency bins where P(k,l) has isolated peaks. This is shown in FIG. 2A. The isolated peaks of the estimated speech amplitude $\hat{A}(k,l)$ are music noise.

$R(k,l)^2$ and $\lambda_N(k,l)$ are at a similar average level for the above-stated frame designated by box 14. This is because content of the frame designated by box 14 is mostly noise. For this reason, $R(k,l)^2$ is the instantaneous noise level. $\lambda_N(k,l)$ is an estimated smoothed noise level or as stated above the estimated a priori variance of noise. The fact that $R(k,l)^2$ has a similar average level as $\lambda_N(k,l)$ indicates $\lambda_N(k,l)$ is estimated correctly.

SUMMARY

A system is provided and includes a first gain module, an operator module, an a priori module, a posteriori module, and a second gain module. The first gain module is configured to apply a non-linear function to generate a gain signal based on (i) an amplitude of a first speech signal, and (ii) an estimated a priori variance of noise contained in the first speech signal. The operator module is configured to generate an operator based on (i) the gain signal, and (ii) the estimated a priori variance of noise. The a priori module is configured to determine an a priori signal-to-noise ratio based on the operator. The posteriori module is configured to determine a posteriori signal-to-noise ratio based on (i) the amplitude of the first speech signal, and (ii) the estimated a priori variance of noise. The second gain module is configured to: determine a gain value based on (i) the a priori signal-to-noise ratio, and (ii) the a posteriori signal-to-noise ratio, and generate, based on (i) the amplitude of the first speech signal and (ii) the gain value, a second speech signal that corresponds to an estimate of an amplitude of the speech signal, where the second speech signal is substantially void of music noise.

In other features, a method is provided and includes: applying a non-linear function to generate a gain signal based on (i) an amplitude of a first speech signal, and (ii) an estimated a priori variance of noise included in the first speech signal; generating an operator based on (i) the gain signal, and (ii) the estimated a priori variance of noise; determining an a priori signal-to-noise ratio based on the operator; and determining a posteriori signal-to-noise ratio based on (i) the amplitude of the first speech signal, and (ii) the estimated a priori variance of noise. The method further includes: determining a gain value based on (i) the a priori signal-to-noise ratio, and (ii) the a posteriori signal-to-noise ratio; and based on (i) the amplitude of the first speech signal, and (ii) the gain value, generating a second speech signal that corresponds to an estimate of an amplitude of the first speech signal, where the second speech signal is substantially void of music noise.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF DRAWINGS

In the drawings, reference numbers may be reused to identify similar and/or identical elements.

DESCRIPTION

Figure 2A:
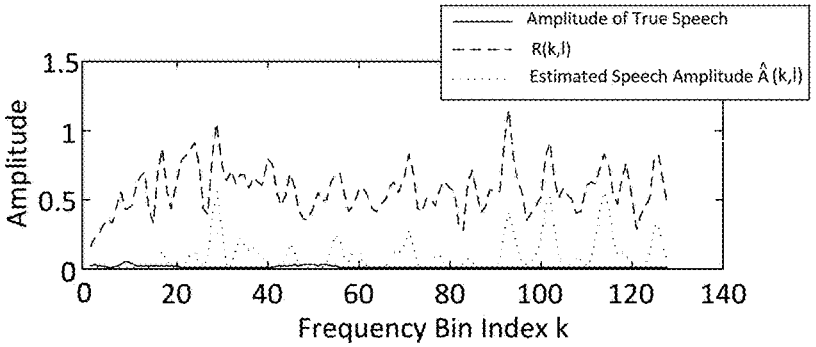
FIG. 2A is a plot of amplitudes of true speech, amplitudes of noisy speech R(k,l), and estimated speech amplitudes $\hat{A}(k,l)$ corresponding to the noisy speech signal and the clean speech signal of FIG. 1.
Figure 2B:
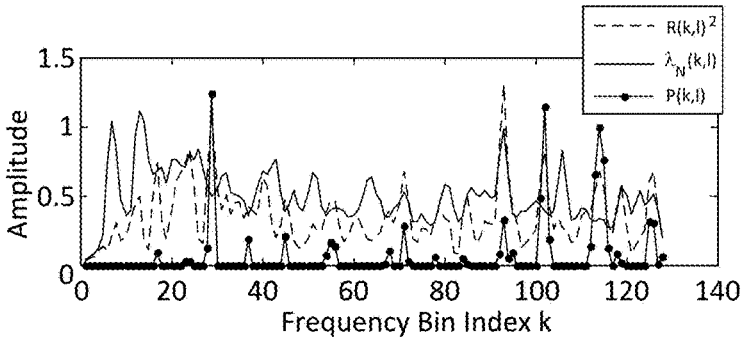
FIG. 2B is a plot of $R(k,l)^2$, an estimated a priori variance of noise $\lambda_N(k,l)$, and an operator P(k,l), which is used for estimating the speech amplitudes $\hat{A}(k,l)$ of FIG. 1.

In review of FIGS. 2A and 2B, scaling of the estimated a priori variance of noise $\lambda_N(k,l)$ may be considered to eliminate the isolated peaks created when comparing $R(k,l)^2$ and $\lambda_N(k,l)$. Removal of the peaks results in elimination of music noise. For example, above provided equation 4 may be modified to provide equation 5, where s is a value greater than 1.

$$P(k,l)=\begin{cases}\gamma(k,l)-s=\dfrac{R(k,l)^2-s\cdot\lambda_N(k,l)}{\lambda_N(k,l)}, & R(k,l)^2>s\cdot\lambda_N(k,l)\\ 0, & \text{otherwise}\end{cases} \quad (5)$$

The larger the value of s, the fewer isolated peaks in P(k,l). However, as long as isolated peaks exist in P(k,l), music noise is produced. With fewer isolated peaks, the music noise is more narrowly banded and as a result can be more annoying to a listener. To completely eliminate the isolated peaks, s must be increased to a large value such that $R(k,l)^2<s\cdot\lambda_N(k,l)$ for all values of k. This requires a large value of s, since R(k,l) is instantaneous (not smoothed). Referring now to the example noisy speech signal 12 of FIG. 1, in order to completely eliminate the isolated peaks of P(k,l) s would have to be as large as 5. A large value of s causes distortions in a corresponding speech signal.

Figure 3:
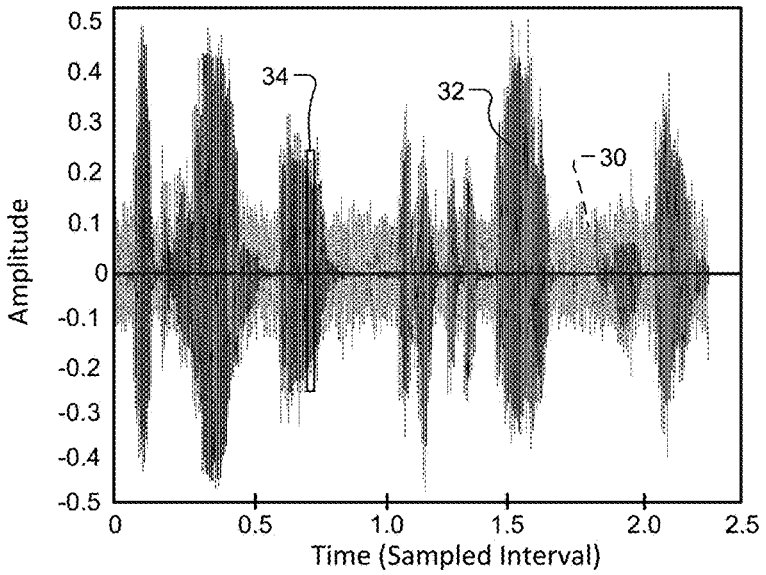
FIG. 3 is another plot of a noisy speech signal and a clean speech signal.

As another example, FIG. 3 shows plots of a noisy speech signal 30 and a clean speech signal 32. The noisy speech signal 30 includes speech (or speech samples) and noise. The clean speech signal 32 is the speech without noise. An example frame of the noisy speech signal 30 is within box 34. The frame designated by box 34 contains significant speech since the average amplitudes of the speech are much larger than the average amplitudes of the noise.

Figure 4A:
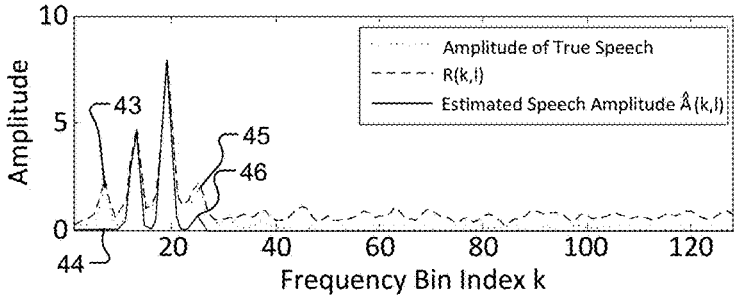
FIG. 4A is a plot of amplitudes of true speech, amplitudes of noisy speech R(k,l), and estimated speech amplitudes $\hat{A}(k,l)$ corresponding to the noisy speech signal and the clean speech signal of FIG. 3.
Figure 4B:
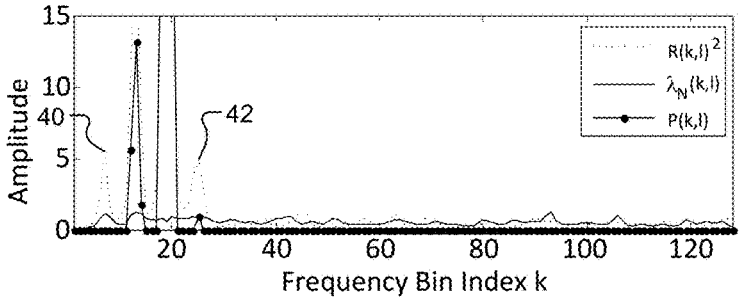
FIG. 4B is a plot of $R(k,l)^2$, an estimated a priori variance of noise $\lambda_N(k,l)$, and an operator P(k,l), which is used for estimating the speech amplitudes $\hat{A}(k,l)$ of FIG. 3.

FIG. 4A shows examples of amplitudes of true speech, amplitudes of noisy speech (or noisy speech signal) R(k,l), and estimated speech amplitudes $\hat{A}(k,l)$. FIG. 4B shows examples of values of the variables in equation 5 with s being equal to 5. The values of FIG. 4B correspond to the values of FIG. 4A. From FIG. 4B, it can be seen that a first peak 40 and a fourth peak 42 of $R(k,l)^2$ and a first peak 43 and a fourth peak 45 of the true speech are smaller than or comparable in amplitude to peaks of $s\cdot\lambda_N(k,l)$. As a result, the first peak 40 and fourth peak 42 are essentially ignored using equation 5. Points of the estimated speech amplitude $\hat{A}(k,l)$ corresponding to the peaks 40, 42, 43, 45 are significantly reduced, as shown in FIG. 4A, where the first peak is eliminated (designated by point 44) and amplitude of the fourth peak (designated by point 46) is reduced. The amplitude of the fourth peak 46 is reduced compared to the fourth peak 45 of the true speech signal. Thus, a noise reduction process that uses equation 5 as described above does not eliminate music noise and/or causes distortion in speech. A noise reduction process that uses equation 5 either does not eliminate the music noise (e.g., a small number of isolated peaks remain in P(k,l)) or creates distortion in a speech signal. Examples are disclosed below that eliminate music noise with minimal speech distortion.

Figure 5:
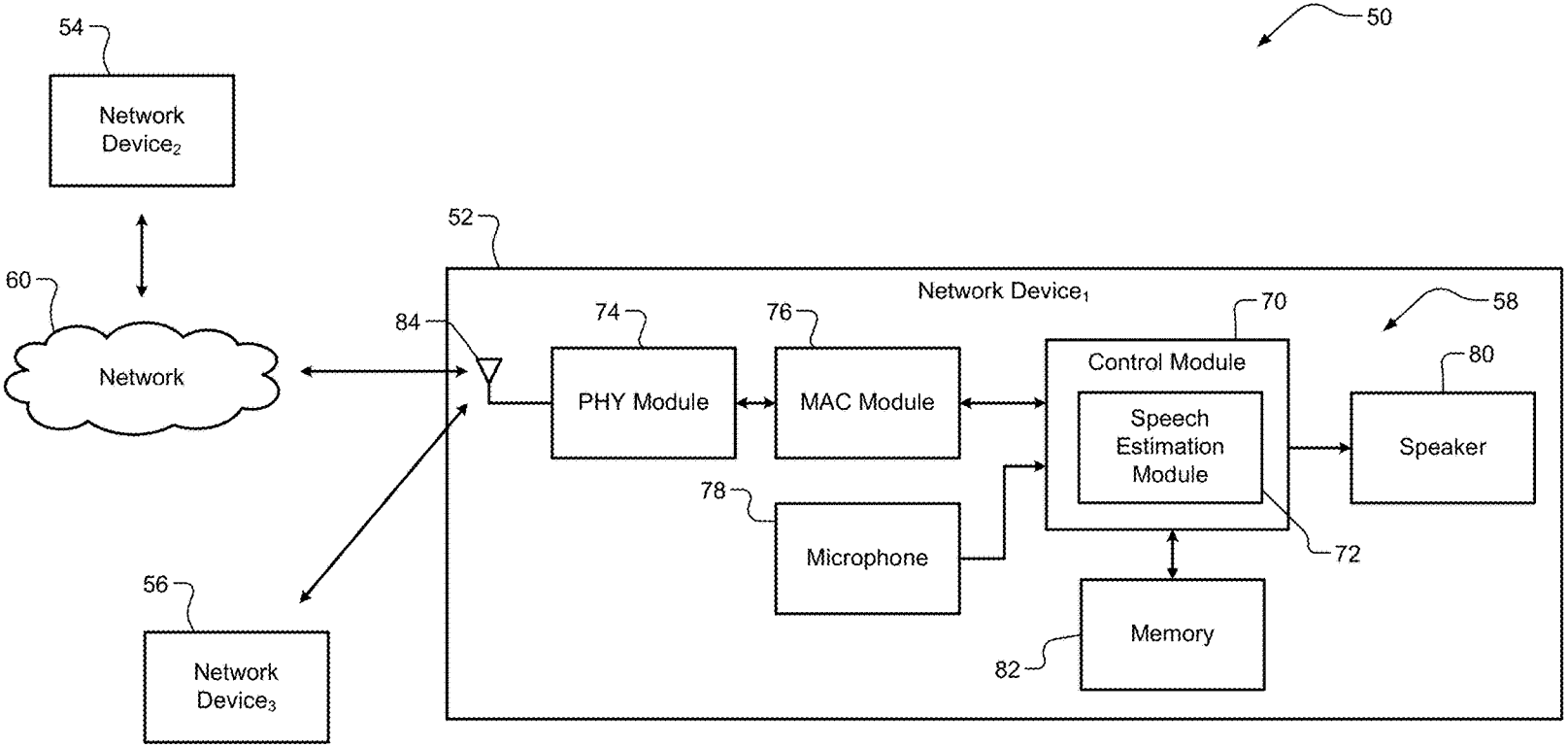
FIG. 5 is a functional block diagram of an audio network including a network device with a speech estimation module in accordance with an aspect of the present disclosure.

FIG. 5 shows an audio network 50 including network devices 52, 54, 56. The network devices 52, 54, 56 communicate with each other directly or via a network 60 (e.g., the Internet). The communication may be wireless or via wires. Audio signals, such as speech signals, may be transmitted between the network devices 52, 54, 56. The network device 52 is shown having an audio system 58 with multiple modules and devices. The network devices 54, 56 may include similar modules and/or devices as the network device 52. Each of the network devices 54, 56 may be, for example, a mobile device, a cellular phone, a computer, a tablet, an appliance, a server, a peripheral device and/or other network device.

The network device 52 may include: a control module 70 with a speech estimation module 72; a physical layer (PHY) module 74, a medium access control (MAC) module 76, a microphone 78, a speaker 80 and a memory 82. The speech estimation module 72 receives a noisy speech signal, attenuates noise in the noisy speech signal and eliminates and/or prevents generation of music noise with minimal or no speech distortion. The noisy speech signal may be received by the network device 52 from the network device 54 via the network 60 or by the network device 52 directly from the network device 56. The noisy speech signal may be received via an antenna 84 at the PHY module 74 and forwarded to the control module 70 via the MAC module 76. As an alternative, the noisy speech signal may be generated based on an analog audio signal detected by the microphone 78. The noisy speech signal may be generated by the microphone 78 and provided from the microphone 78 to the control module 70.

The speech estimation module 72 provides an estimated speech amplitude signal $\hat{A}(k,l)$ (sometimes referred to as an estimated clean speech signal) based on the noisy speech signal. The speech estimation module 72 may perform an inverse fast Fourier transform (IFFT) and a digital-to-analog (D/A) conversion of the estimated speech amplitude signal $\hat{A}(k,l)$ to provide an output signal. The output signal may be provided to the speaker 80 for playout or may be transmitted back to one of the network devices 54, 56 via the modules 74, 76 and the antenna 84.

An audio (or noisy speech) signal may be originated at the network device 52 via the microphone 78 and/or accessed from the memory 82 and passed through the speech estimation module 72. The resultant signal generated by the speech estimation module 72 corresponding to the audio signal may be played out on the speaker 80 and/or transmitted to the network devices 54, 56 via the modules 74, 76 and the antenna 84.

Figure 6:
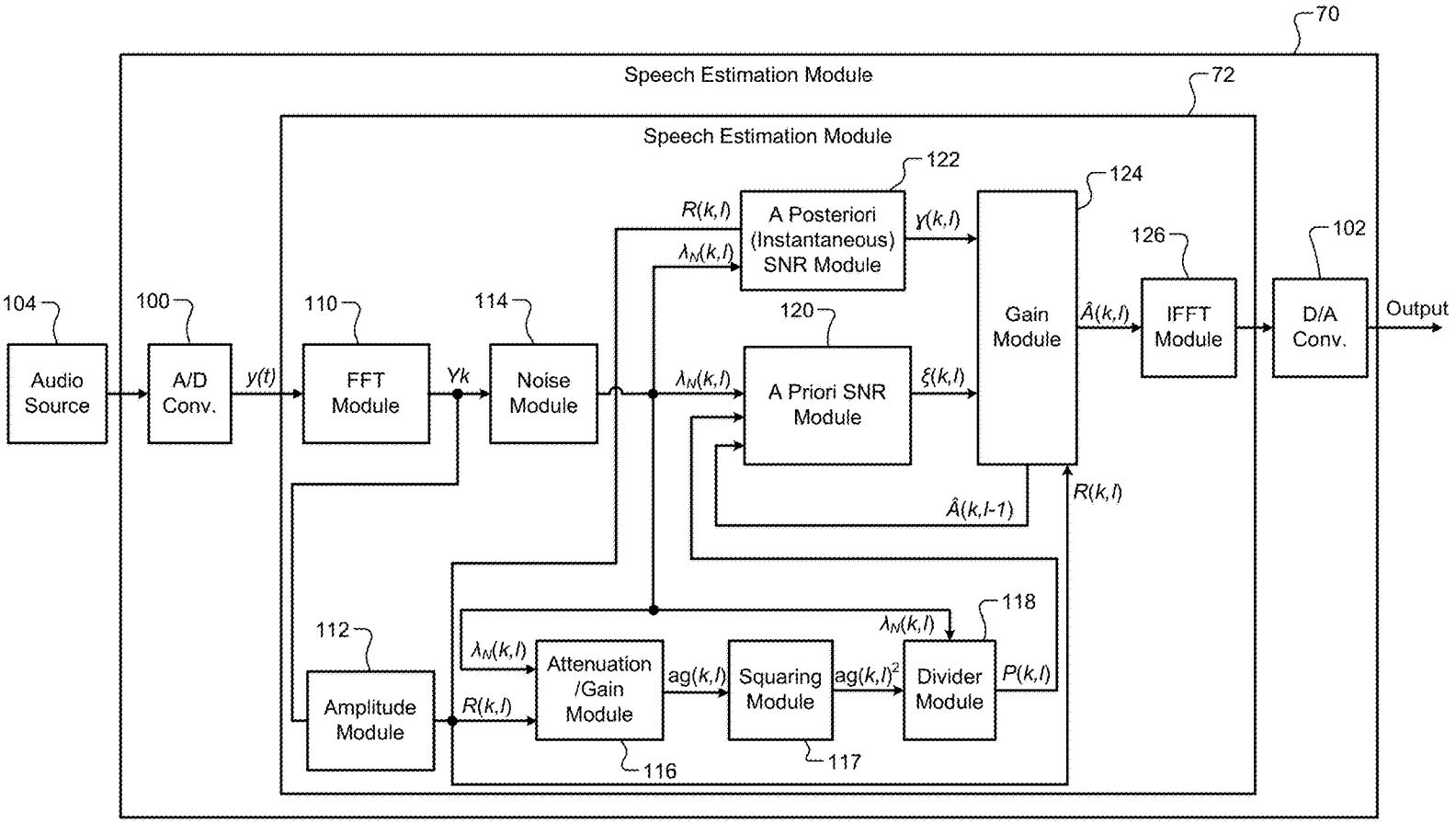
FIG. 6 is a functional block diagram of a control module including the speech estimation module in accordance with an aspect of the present disclosure.

Referring now also to FIG. 6, which shows the control module 70 according to one embodiment. The control module 70 may include an analog-to-digital (A/D) converter 100, the speech estimation module 72, and a D/A converter 102. The A/D converter 100 receives an analog noisy speech signal from an audio source 104, such as: one of the network devices 54, 56 via the modules 74, 76 and the antenna 84; the microphone 78; the memory 82; and/or other audio source. The A/D converter 100 converts the analog noisy speech signal to a digital noisy speech signal. The speech estimation module 72 eliminates music noise from the digital noisy speech signal and/or prevents generation of music noise while attenuating noise in the digital noisy speech signal to provide the estimated speech amplitude signal $\hat{A}(k,l)$. The speech estimation module 72 may receive the digital noisy speech signal directly from the audio source 104. The D/A converter 102 may convert an estimated speech amplitude signal received from the speech estimation module 72 to an analog signal prior to playout and/or transmission to one of the network devices 54, 56.

Figure 7:
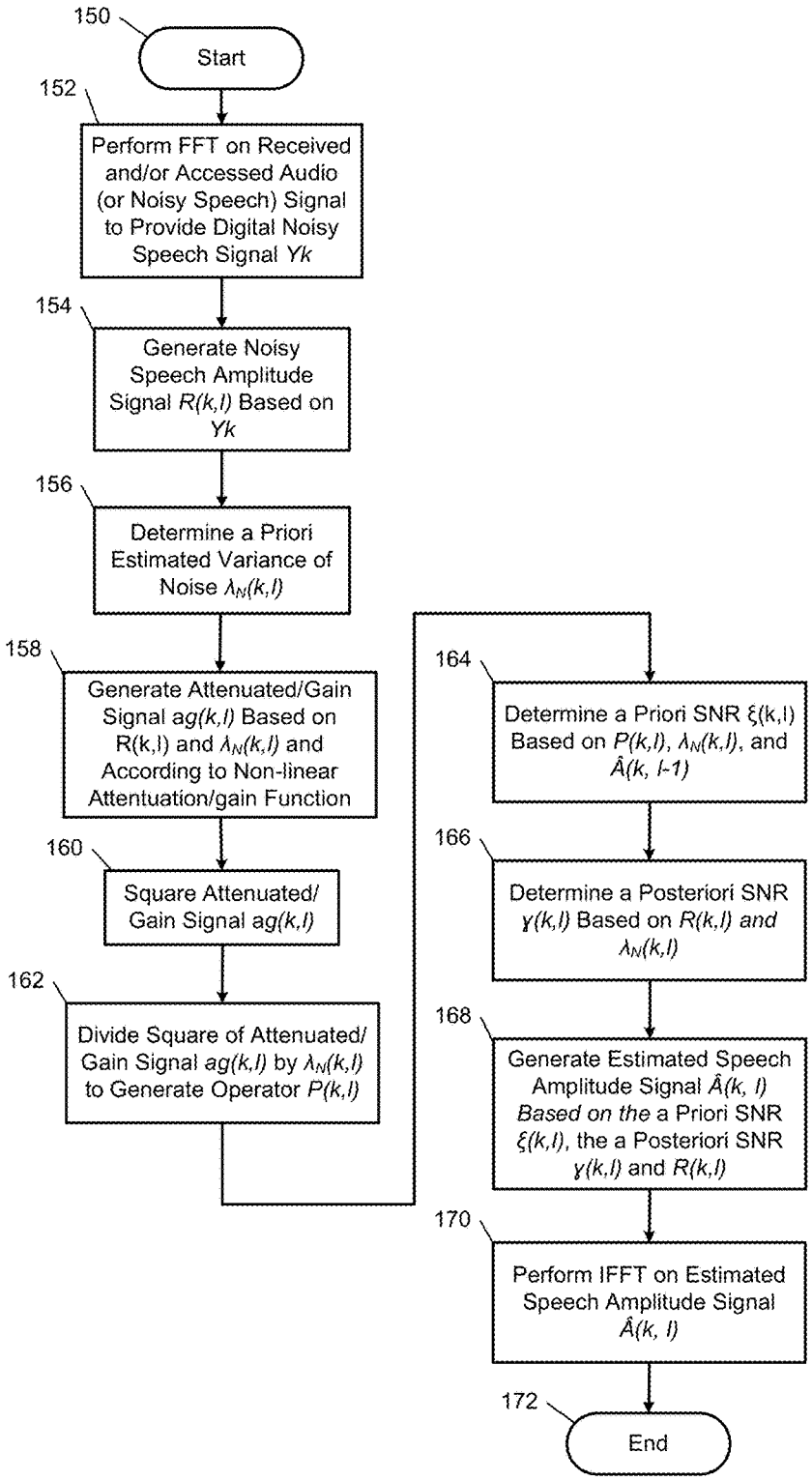
FIG. 7 illustrates a speech estimation method in accordance with an aspect of the present disclosure.

The speech estimation module 72 may include a fast Fourier transform (FFT) module 110, an amplitude module 112, a noise module 114, an attenuation/gain module 116, a squaring module 117, a divider module 118, an a priori SNR module 120, an a posteriori (or instantaneous) SNR module 122, a second gain module 124, and an IFFT module 126. Modules 116, 117, 118 may be included in and/or implemented as a single non-linear function module. Modules 117 and 118 may be included in and/or implemented as a single operator module. Operation of the modules 110, 112, 114,

116, 117, 118, 120, 122, 124 and 126 are described with respect to the method of FIG. 7.

The systems disclosed herein may be operated using numerous methods, an example method is illustrated in FIG. 7. In FIG. 7, illustrates a speech estimation method. Although the following tasks are primarily described with respect to the implementations of FIGS. 5-6 and 8-10, the tasks may be easily modified to apply to other implementations of the present disclosure. The tasks may be iteratively performed.

The method may begin at 150. At 152, the FFT module 110 may perform a fast Fourier transform on a received and/or accessed audio (or noisy speech) signal y(t) to provide a digital noisy speech signal $Y_k$, where t is time and k is a frequency bin index. At 154, the amplitude module 112 may determine amplitudes of the digital noisy speech signal $Y_k$ and generate a noisy speech amplitude signal R(k,l). The noisy speech amplitude signal R(k,l) may be generated as the amplitude of the complex digital noisy speech signal $Y_k$. At 156, the noise module 114 determines an estimated a priori variance of noise $\lambda_N(k,l)$ based on the digital noisy speech signal $Y_k$.

Tasks 158 and 160 may be performed according to equation 6, where g[ ] is a non-linear attenuation/gain function with inputs R(k,l) and $\lambda_N(k,l)$.

$$P(k,l) = \frac{g[R(k,l), \lambda_N(k,l)]^2}{\lambda_N(k,l)} = \frac{ag(k,l)^2}{\lambda_N(k,l)} \tag{6}$$

Figure 8:
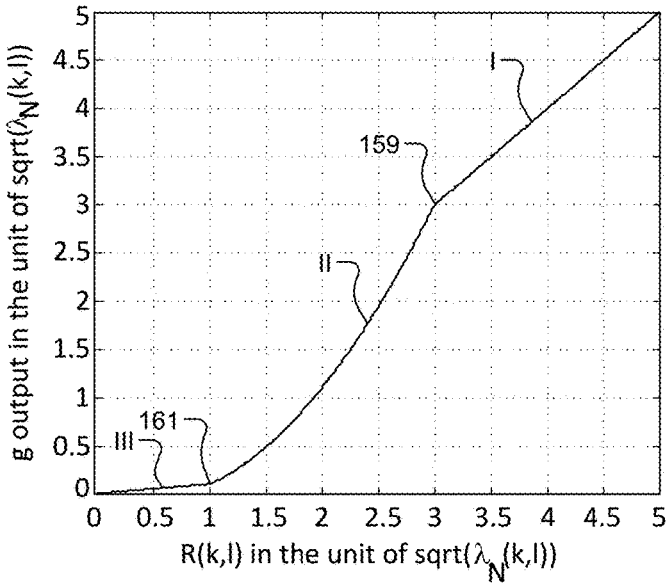
FIG. 8 is a plot of a non-linear attenuation/gain function in accordance with an aspect of the present disclosure.

At 158, the attenuation/gain (or first function) module 116 generates an attenuated/gain signal ag(k,l) based on the noisy speech amplitude signal R(k,l) and the estimated a priori variance of noise $\lambda_N(k,l)$. The attenuated/gain signal ag(k,l) is the result of the non-linear attenuation/gain function g[ ] and may be generated according to the following rule:

1. If $R(k,l)^2 \gg \lambda_N(k,l)$, then the output of the non-linear attenuation/gain function g[ ] or ag(k,l) is equal to R(k,l). The symbol "≫" means substantially greater than and may refer to a predetermined amount greater than $\lambda_N(k,l)$. This is represented by a first portion I of the plot of FIG. 8. The first portion I may be linear. FIG. 8 shows an example plot that is representative of the non-linear attenuation/gain function. The plot includes three portions I, II, III and is the output of the non-linear attenuation/gain function g[ ] versus the estimated a priori variance of noise $\lambda_N(k,l)$.
2. If $R(k,l)^2$ is not substantially greater than $\lambda_N(k,l)$, then the output of the non-linear attenuation/gain function g[ ] or ag(k,l) may be an attenuated version of R(k,l) or the amount of gain may be decreased to 0. The attenuated amount or the amount of gain may be predetermined, fixed and/or variable. The attenuated amount may increase as R(k,l) decreases, as illustrated by portions II and III of the plot of FIG. 8. The amount of attenuation of R(k,l) for the portion III is greater than the amount of attenuation of R(k,l) for the portion II. The portion II may be non-linear and transitions from decreasing amounts of gain to increasing amounts of attenuation with decreasing R(k,l). The portion III may be linear and provides increasing amounts of attenuation with decreasing R(k,l). Points 159 and 161 are points between the portions I, II and III where the slope of the overall curve of FIG. 8 changes from a first slope of a first one of the portions I, II, III to a second slope of a second one of the portions I, II, III. Although the non-linear attenuation/gain function shown in FIG. 8 has three portions with certain linearity and/or non-linearity, the non-linear attenuation/gain function may have any number of portions with respective linearity and/or non-linearity. The portions I, II, III have respective amounts of attenuation and/or gain.
3. Mapping performed by the attenuation/gain module 116 from R(k,l) to the output ag(k,l) is continuous and monotonic. The output ag(k,l) is 0 when R(k,l) is 0 and is non-negative, since R(k,l) is greater than or equal to 0.

At 160, the squaring (or second function) module 117 squares the output ag(k,l) to provide $ag(k,l)^2$. At 162, the divider (or third function) module 118 divides $ag(k,l)^2$ by the $\lambda_N(k,l)$ to provide P(k,l) of equation 6.

By using the above-described rule and equation 6, music noise is eliminated by avoiding creation of isolated peaks. Note that equation 6 does not include the subtractions in equations 4 and/or 5. Since speech energy is greater than noise energy, if $R(k,l)^2 \gg \lambda_N(k,l)$, then the corresponding signal energy is most likely speech energy, not noise energy. For this reason, the signal is not modified. In other words, the output ag(k,l) is equal to R(k,l). Otherwise, the likelihood of the signal energy being speech decreases and the likelihood of the signal energy being noise increases with decreasing R(k,l). For this reason, a reduced amount of gain and/or an attenuated P(k,l) is generated leading to a reduced amount of noise. When $R(k,l)^2$ is about the same as (e.g., within a predetermined amount of) $\lambda_N(k,l)$ or is less than $\lambda_N(k,l)$, then R(k,l) is most likely noise and is heavily attenuated. This reduces noise and also aids in preventing formation of isolated peaks.

Isolated peaks are formed because of discontinuities associated with, for example, equation 4. This is because at one particular frequency bin when $R(k,l)^2 < \lambda_N(k,l)$ equation 4 results in P(k,l) being equal to 0, but at a next frequency bin when $R(k+1,l)^2 > \lambda_N(k+1,l)$ equation 4 provides a nonzero large value for $$P(k+1,l) = \frac{R(k+1,l)^2 - \lambda_N(k+1,l)}{\lambda_N(k+1,l)}.$$

In the proposed algorithm, because of feature 3 of the above-stated rule associated with equation 6, P(k,l)>0. Also, because of feature 2 of the above-stated rule, P(k+1,l) may be a heavily attenuated value. For these reasons, an isolated peak that would result in music noise is not created.

There are numerous possible non-linear attenuation/gain functions that may be used for g[ ]. FIG. 8 and the above-stated rule provide one example. As another example, if R(k,l) is greater than a product of a first predetermined amount (e.g., 3) and $\lambda_N(k,l)$, then ag(k,l) is set equal to R(k,l). Otherwise, if R(k,l) is less than or equal to a product of the first predetermined amount and $\lambda_N(k,l)$ and/or $R(k,l) \leq \sqrt{\lambda_N(k,l)}$, then ag(k,l) is set equal to an attenuated version of R(k,l), such as a product of a second predetermined amount (e.g., 0.1) and R(k,l).

At 164, the a priori SNR module (or first SNR module) 120 determines a priori SNR $\xi(k,l)$ based on the P(k,l) and $\lambda_N(k,l)$ and a previous amplitude $\hat{A}(k,l-1)$. The previous amplitude $\hat{A}(k,l-1)$ may be generated by the gain module 124 for a previous frame of the received and/or accessed speech signal. At 166, the a posteriori SNR module (or second SNR module) 122 may determine a posteriori SNR $\gamma(k,l)$ based on the $R(k,l)$ and $\lambda_N(k,l)$.

At 168, the gain (or second gain) module 124 may generate an estimated speech amplitude signal $\hat{A}(k,l)$ as a function of $\xi(k,l)$ and/or $\gamma(k,l)$. As an example, equations 7-10 may be used to generate the estimated speech amplitude signal $\hat{A}(k,l)$, where v is a parameter defined by equation 7 and G is gain applied to $R(k,l)$.

$$v = \frac{\xi}{1+\xi}\gamma \tag{7}$$

$$\hat{A} = \frac{\left|\sqrt[2]{v(1-v)}\right|}{\gamma} \cdot R(k,l) \tag{8}$$

$$G = \frac{\left|\sqrt[2]{v(1-v)}\right|}{\gamma} \tag{9}$$

$$\hat{A} = G \cdot R(k,l) \tag{10}$$

The estimated speech amplitude signal $\hat{A}(k,l)$ may be provided from the gain module 124 to the IFFT module 126. Values of the gain G may be greater than or equal to 0 and less than or equal to 1. The values of the gain G are set to attenuate noise and maintain amplitudes of speech. At 170, the IFFT module 126 performs an IFFT of the estimated speech amplitude signal $\hat{A}(k,l)$ to provide an output signal, which may be provided to the D/A converter 102. The method may end at 172.

The above-described tasks are meant to be illustrative examples; the tasks may be performed sequentially, synchronously, simultaneously, continuously, during overlapping time periods or in a different order depending upon the application. Also, any of the tasks may not be performed or skipped depending on the implementation and/or sequence of events. For example, tasks 152 and/or 170 may be skipped.

Figure 1:
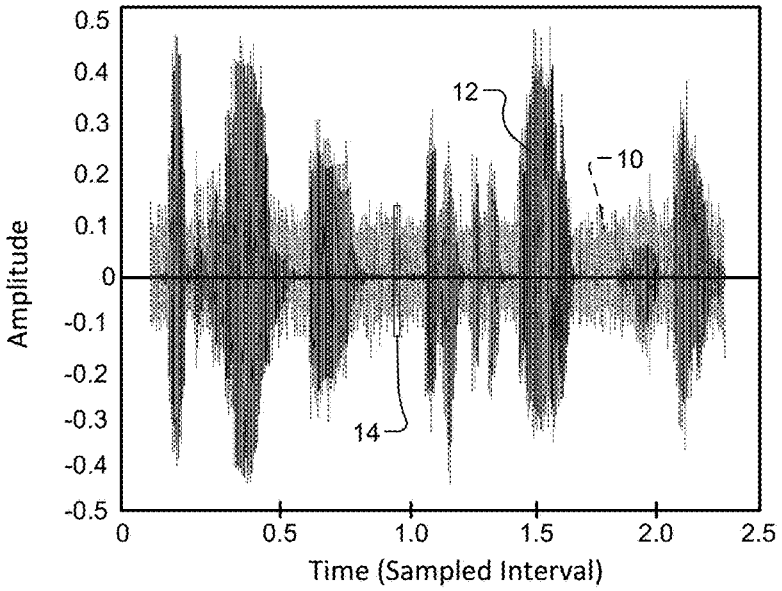
FIG. 1 is a plot of a noisy speech signal and a clean speech signal.
Figure 9A:
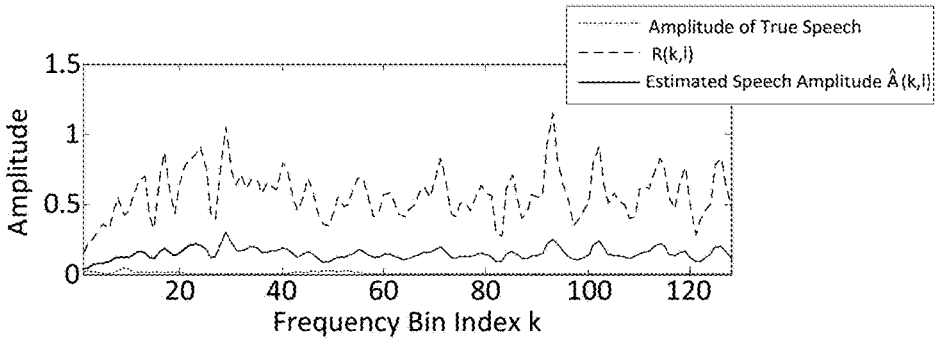
FIG. 9A is a plot of amplitudes of true speech, amplitudes of noisy speech R(k,l), and estimated speech amplitudes $\hat{A}(k,l)$ provided using the non-linear attenuation/gain function for a noisy speech signal in accordance with an aspect of the present disclosure.
Figure 9B:
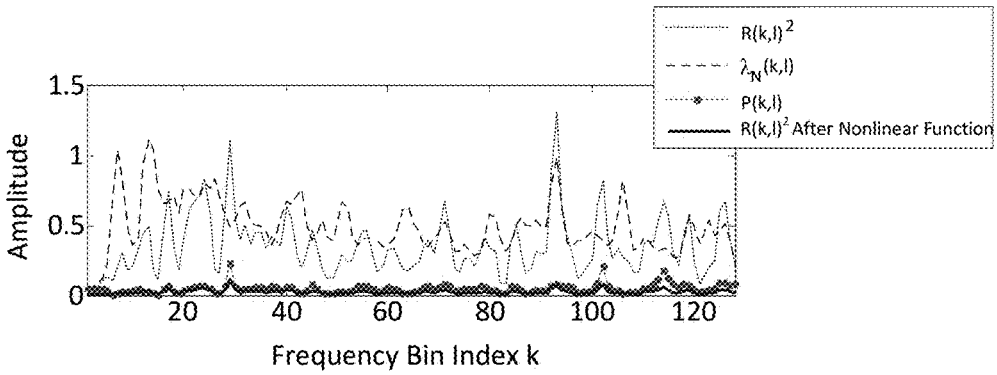
FIG. 9B is a plot of an estimated a priori variance of noise $\lambda_N(k,l)$, an operator P(k,l), and $R(k,l)^2$ prior to and after applying the non-linear attenuation/gain function of FIG. 9A.

By applying the non-linear attenuation/gain functions described above to provide an operator $P(k,l)$, the subsequent determination of a priori SNR $\xi(k,l)$ and the generation of the estimated clean speech signal $\hat{A}(k,l)$ do not introduce music noise. For example, by applying the non-linear attenuation/gain function of FIG. 8, for the frame designated by box 14 of the noisy speech signal 10 of FIG. 1, provides the estimated speech amplitude $\hat{A}(k,l)$ of FIG. 9A. Prior to being "cleaned" (i.e. prior to the non-linear attenuation/gain function being applied and the gain module 124 applying the gain function G to the amplitudes of noisy speech $R(k,l)$) the frame designated by box 14 has mostly noise. FIG. 9A shows a plot of: amplitudes of true speech; amplitudes of noisy speech $R(k,l)$; and the estimated speech amplitudes $\hat{A}(k,l)$ provided using the non-linear attenuation/gain function for a noisy speech signal. FIG. 9B shows a plot of: $R(k,l)^2$ prior to and after applying the non-linear attenuation/gain function; the estimated a priori variance of noise $\lambda_N(k,l)$; and the operator $P(k,l)$, which is used for estimating the speech amplitudes $\hat{A}(k,l)$ of FIG. 9A.

Figure 10A:
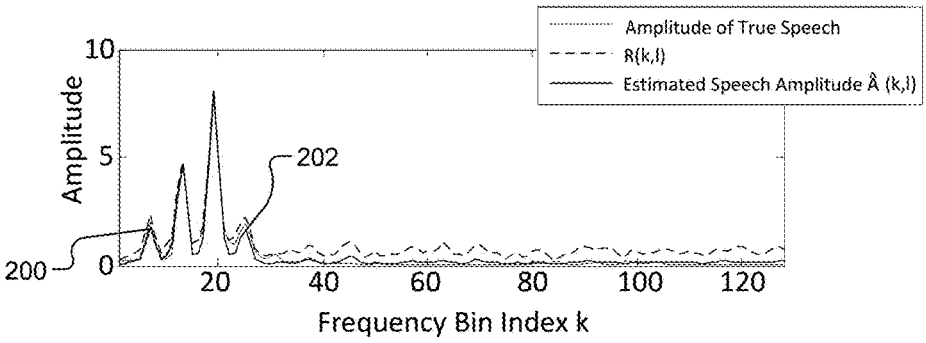
FIG. 10A is a plot of amplitudes of true speech, amplitudes of noisy speech R(k,l), and estimated speech amplitudes $\hat{A}(k,l)$ provided using the non-linear attenuation/gain function for another noisy speech signal in accordance with an aspect of the present disclosure.
Figure 10B:
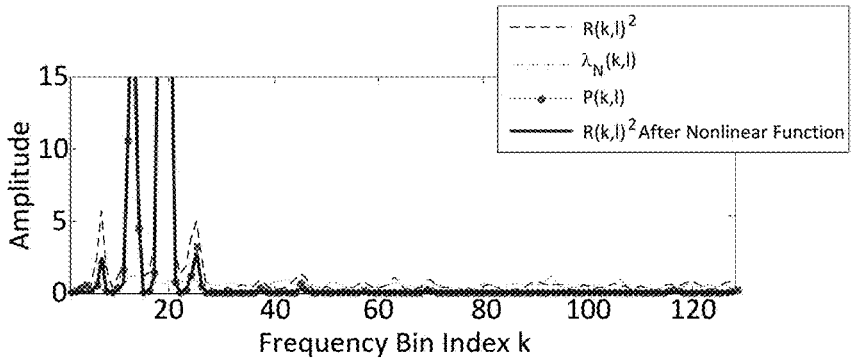
FIG. 10B is a plot of an estimated a priori variance of noise $\lambda_N(k,l)$, an operator P(k,l), and $R(k,l)^2$ prior to and after applying the non-linear attenuation/gain function of FIG. 10A.

By applying the non-linear attenuation/gain function of FIG. 8, for the frame designated by box 34 of the noisy speech signal 30 of FIG. 3, provides the estimated speech amplitude $\hat{A}(k,l)$ of FIG. 10A. Prior to being cleaned the frame designated by box 34 has a significant amount of speech. FIG. 10A shows a plot of: amplitudes of true speech; amplitudes of noisy speech $R(k,l)$; and the estimated speech amplitudes $\hat{A}(k,l)$ provided using the non-linear attenuation/gain function. FIG. 10B shows a plot of: $R(k,l)^2$ prior to and after applying the non-linear attenuation/gain function; the estimated a priori variance of noise $\lambda_N(k,l)$; and the operator $P(k,l)$, which is used for estimating the speech amplitudes $\hat{A}(k,l)$ of FIG. 10A.

As can be seen in FIG. 9A, there are no sharp isolated peaks and no music noise. Although this embodiment shows no music noise, in other embodiments of the present disclosure, the music noise is substantially eliminated, but not completely eliminated. For the embodiments in which the music noise is substantially eliminated, substantially eliminated refers to the estimated speech amplitude not having sharp isolated peaks and the amplitude of the music noise being less than a predetermined fraction of the amplitude of the true speech and/or the noisy speech signal. In one embodiment, the predetermined fraction is ⅕, 1/10, or 1/100. The music noise may be within a predetermined range (e.g., 0.1) of the predetermined fraction. A wideband noise with low amplitude exists instead of the music noise. The wideband noise may not be heard and/or is not annoying to a listener. As can be seen in FIG. 10A, unlike the first and fourth peaks 44, 46 of the estimated speech amplitude of FIG. 4A, the first and fourth peaks 200, 202 of the estimated speech amplitude of FIG. 10A are not or minimally attenuated and are not distorted. Thus, the peaks of the speech are preserved as compared to the peaks of the corresponding true speech and/or the noisy speech signal $R(k,l)$.

The wireless communications described in the present disclosure can be conducted in full or partial compliance with IEEE standard 802.11-2012, IEEE standard 802.16-2009, IEEE standard 802.20-2008, and/or Bluetooth Core Specification v4.0. In various implementations, Bluetooth Core Specification v4.0 may be modified by one or more of Bluetooth Core Specification Addendums 2, 3, or 4. In various implementations, IEEE 802.11-2012 may be supplemented by draft IEEE standard 802.11ac, draft IEEE standard 802.11ad, and/or draft IEEE standard 802.11ah.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In this application, including the definitions below, the term "module" or the term "controller" may be replaced with the term "circuit." The term "module" refers to or includes: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A system comprising:

a first gain module configured to apply a non-linear function to generate a gain signal based on (i) an amplitude of a first speech signal, and (ii) an estimated a priori variance of noise included in the first speech signal;

an operator module configured to generate an operator based on (i) the gain signal, and (ii) the estimated a priori variance of noise;

an a priori module configured to determine an a priori signal-to-noise ratio based on the operator;

a posteriori module configured to determine a posteriori signal-to-noise ratio based on (i) the amplitude of the first speech signal, and (ii) the estimated a priori variance of noise; and a second gain module configured to determine a gain value based on (i) the a priori signal-to-noise ratio, and (ii) the a posteriori signal-to-noise ratio, and generate, based on (i) the amplitude of the first speech signal and (ii) the gain value, a second speech signal that corresponds to an estimate of an amplitude of the first speech signal, wherein the second speech signal is substantially void of music noise.

2. The system of claim 1, further comprising:

an amplitude module configured to determine the amplitude of the first speech signal; and a noise module configured to determine the estimated a priori variance of noise of the first speech signal.

3. The system of claim 2, wherein:

the first speech signal includes a first frame of data and a second frame of data;

the first frame is received by the amplitude module and the noise module prior to the second frame;

the second gain module is configured to generate the estimated speech amplitude for the second frame;

the a priori module is configured to generate the a priori signal-to-noise ratio for the second frame based on (i) the a priori estimated variance of noise, and (ii) an estimated speech amplitude for the first frame;

the amplitude of the first speech signal is based on the second frame; and the noise module is configured to determine the estimated a priori variance of noise of the first speech signal for the second frame.

4. The system of claim 1, wherein the first gain module is configured to apply the non-linear function such that the gain signal is equal to the amplitude of the first speech signal if a square of the first speech signal is a predetermined amount greater than the estimated a priori variance of noise.

5. The system of claim 4, wherein the first gain module is configured to apply the non-linear function such that if the square of the first speech signal is less than a sum of the predetermined amount and the estimated a priori variance of noise, then less gain is provided for the operator than when the square of the first speech signal is the predetermined amount greater than the estimated a priori variance of noise.

6. The system of claim 4, wherein the non-linear function comprises a linear portion and a non-linear portion.

7. The system of claim 4, wherein the non-linear function comprises a first linear portion, a non-linear portion and a second linear portion.

8. The system of claim 7, wherein the second linear portion provides more attenuation than the non-linear portion.

9. The system of claim 7, wherein:

the first linear portion corresponds to when the square of the first speech signal is the predetermined amount greater than the estimated a priori variance of noise;

the non-linear portion corresponds to when the square of the first speech signal is less than a sum of the predetermined amount and the estimated a priori variance of noise, and greater than the estimated a priori variance of noise; and the second linear portion corresponds to when the square of the first speech signal is less than or equal to the estimated a priori variance of noise.

10. The system of claim 4, wherein the gain signal is greater than 0 when the amplitude of the first speech signal is not equal to 0.

11. The system of claim 4, wherein:

the gain signal is equal to the amplitude of the first speech signal when the amplitude of the first speech signal is greater than a second predetermined amount times a square root of the estimated a priori variance of noise; and the gain signal is equal to a product of a third predetermined amount and the amplitude of the first speech signal when the amplitude of the first speech signal is less than or equal to the square root of the estimated a priori variance of noise.

12. A method comprising:

applying a non-linear function to generate a gain signal based on (i) an amplitude of a first speech signal and (ii) an estimated a priori variance of noise included in the first speech signal;

generating an operator based on (i) the gain signal, and (ii) the estimated a priori variance of noise;

determining an a priori signal-to-noise ratio based on the operator;

determining a posteriori signal-to-noise ratio based on (i) the amplitude of the first speech signal, and (ii) the estimated a priori variance of noise;

determining a gain value based on (i) the a priori signal-to-noise ratio, and (ii) the a posteriori signal-to-noise ratio; and based on (i) the amplitude of the first speech signal, and (ii) the gain value, generating a second speech signal that corresponds to an estimate of an amplitude of the first speech signal, wherein the second speech signal is substantially void of music noise.

13. The method of claim 12, further comprising:

determining the amplitude of the first speech signal; and determining the estimated a priori variance of noise of the first speech signal.

14. The method of claim 13, wherein:

the first speech signal includes a first frame of data and a second frame of data;

the first frame is received by a noise module prior to the second frame;

generating the estimated speech amplitude for the second frame;

generating the a priori signal-to-noise ratio for the second frame based on (i) the estimated a priori variance of noise, and (ii) an estimated speech amplitude for the first frame;

the amplitude of the first speech signal is based on the second frame; and determining, via the noise module, the estimated a priori variance of noise of the first speech signal for the second frame.

15. The method of claim 12, comprising applying the non-linear function such that the gain signal is equal to the amplitude of the first speech signal if a square of the first speech signal is a predetermined amount greater than the estimated a priori variance of noise.

16. The method of claim 15, comprising applying the non-linear function such that if the square of the first speech signal is less than a sum of the predetermined amount and the estimated a priori variance of noise, then less gain is provided for the operator than when the square of the first speech signal is the predetermined amount greater than the estimated a priori variance of noise.

17. The method of claim 15, wherein the non-linear function comprises a first linear portion, a non-linear portion and a second linear portion.

18. The method of claim 17, wherein the second linear portion provides more attenuation than the non-linear portion.

19. The method of claim 17, wherein:

the first linear portion corresponds to when the square of the first speech signal is the predetermined amount greater than the estimated a priori variance of noise;

the non-linear portion corresponds to when the square of the first speech signal is less than a sum of the predetermined amount and the estimated a priori variance of noise, and greater than the a priori estimated variance of noise; and the second linear portion corresponds to when the square of the first speech signal is less than or equal to the estimated a priori variance of noise.

20. The method of claim 15, wherein:

the gain signal is equal to the amplitude of the first speech signal when the amplitude of the first speech signal is greater than a second predetermined amount times a square root of the estimated a priori variance of noise; and the gain signal is equal to a product of a third predetermined amount and the amplitude of the first speech signal when the amplitude of the first speech signal is less than or equal to the square root of the estimated a priori variance of noise.

21. The system of claim 1, wherein the operator module is configured to generate the operator based on the gain signal squared.

22. The system of claim 21, wherein the operator module is configured to generate the operator based on the gain signal squared divided by the estimated a priori variance of noise.

23. The system of claim 1, further comprising an amplitude module configured to (i) receive the first speech signal based on an output of an audio source, and (ii) output the amplitude of the first speech signal.

24. The system of claim 23, further comprising:

an analog-to-digital converter configured to convert an analog signal to a digital signal;

a fast Fourier transform module configured to transform the digital signal to the first speech signal;

an inverse fast Fourier transform module configured to inverse transform the second speech signal to a second digital signal; and a digital-to-analog converter configured to convert the second digital signal to a second analog signal.

25. A network device comprising:

the system of claim 24; and a speaker configured to play out the second speech signal.

* * * * *